US009711315B2

(12) United States Patent
Andreev

(10) Patent No.: US 9,711,315 B2
(45) Date of Patent: Jul. 18, 2017

(54) AXIAL STRAPPING OF A MULTI-CORE (CASCADED) MAGNETRON

(71) Applicant: Raytheon Company, Waltham, MA (US)

(72) Inventor: Andrey D. Andreev, Albuquerque, NM (US)

(73) Assignee: Raytheon Company, Waltham, MA (US)

( * ) Notice: Subject to any disclaimer, the term of this patent is extended or adjusted under 35 U.S.C. 154(b) by 62 days.

(21) Appl. No.: 14/965,219

(22) Filed: Dec. 10, 2015

(65) Prior Publication Data

US 2017/0169982 A1 Jun. 15, 2017

(51) Int. Cl.
*H01J 25/587* (2006.01)
*H01J 23/05* (2006.01)

(52) U.S. Cl.
CPC ..... *H01J 25/587* (2013.01); *H01J 23/05* (2013.01)

(58) Field of Classification Search
CPC ..... H01J 25/587; H01J 23/05
USPC ..... 313/326
See application file for complete search history.

(56) References Cited

U.S. PATENT DOCUMENTS 2,546,870 A 3/1951 Sayers
3,982,152 A * 9/1976 Smith ..... H01J 25/42 315/3.5
4,006,382 A 2/1977 Butler et al.
4,146,949 A 4/1979 Derby, Jr.
4,162,459 A 7/1979 Scharfman
4,212,423 A 7/1980 Mims
4,424,545 A 1/1984 Faxon
4,571,552 A 2/1986 Brown
4,634,992 A 1/1987 Brown
5,162,698 A 11/1992 Kato et al.
5,216,327 A 6/1993 Myers et al.
6,064,154 A 5/2000 Crouch et al.
6,340,912 B1 1/2002 Gerstenberg et al.
6,373,194 B1 4/2002 Small
(Continued)

FOREIGN PATENT DOCUMENTS

FR EP 2747117 A2 * 6/2014 ..... H01J 25/587

OTHER PUBLICATIONS

U.S. Appl. No. 14/603,987, filed Jan. 23, 2015, Andreev et al.

*Primary Examiner* — Joseph L Williams
*Assistant Examiner* — Christopher Raabe
(74) *Attorney, Agent, or Firm* — Daly, Crowley, Mofford & Durkee, LLP

(57) ABSTRACT

The present disclosure is directed to axial strapping of a multi-core (cascaded) magnetron. The multi-core (cascaded) magnetron includes a cathode and a plurality of cores (anodes) arranged in an axial direction along the cathode. Each of the cores may have a plurality of vanes arranged periodically in an azimuthal direction along a circumference of the cathode and forming by such a way a plurality of resonant cavities. The multi-core (cascaded) magnetron further includes groups of axial straps coupling each of the cores together in the axial direction along the cathode. For example, a first group of axial straps couple the first plurality of vanes of a first core to the second plurality of vanes of a second core. In an embodiment, the axial straps are configured to provide phase synchronization of electromagnetic oscillations induced inside each of the plurality of cores.

24 Claims, 6 Drawing Sheets

(56) References Cited

U.S. PATENT DOCUMENTS

| | | | | |
|---|---|---|---|---|
| 6,414,291 | B1 * | 7/2002 | Kim | H01F 27/324 219/715 |
| 6,504,303 | B2 | 1/2003 | Small | |
| 6,525,477 | B2 | 2/2003 | Small | |
| 6,538,386 | B2 | 3/2003 | Small | |
| 7,265,360 | B2 | 9/2007 | Baker et al. | |
| 7,609,001 | B2 | 10/2009 | Small | |
| 7,696,696 | B2 * | 4/2010 | Fuks | H01J 25/50 315/39.51 |
| 7,893,621 | B2 * | 2/2011 | Schamiloglu | H01J 23/05 219/678 |
| 8,508,132 | B1 * | 8/2013 | Andreev | H01J 25/587 315/39.51 |
| 2008/0246385 | A1 * | 10/2008 | Schamiloglu | H01J 23/05 313/62 |
| 2013/0321099 | A1 * | 12/2013 | Richardson | H01J 23/15 333/182 |

* cited by examiner

AXIAL STRAPPING OF A MULTI-CORE (CASCADED) MAGNETRON

BACKGROUND

As known in the art, a magnetron is a device that uses interaction of a stream of electrons with one of space harmonics of an induced electromagnetic oscillations supported by an anode portion of the magnetron to produce output electromagnetic radiation. The stream of electrons can be produced by a cathode portion of the magnetron and controlled by external crossed electric and magnetic fields. The external crossed electric and magnetic fields are used to support transformation of the kinetic energy of electrons into the energy of induced electromagnetic oscillations to thereby produce the output electromagnetic radiation.

Magnetron typically includes an anode portion or "core" consisting of a periodic set of resonant cavities and vanes surrounding a cathode portion. The operating frequency of the output electromagnetic radiation depends upon the size of the resonant cavities and vanes of the anode portion of the magnetron. These devices can be used in many industries, including radar systems and microwave ovens, as well as in different scientific and military applications.

In some applications, two or more anode portions (cores) might be combined together to form a multi-core or cascaded magnetron. However, the combination of two or more cores creates issues attempting to synchronize electromagnetic oscillations induced inside the individual cores of the multi-core magnetron. Prior attempts to synchronize electromagnetic oscillations in multi-core magnetrons have simply assumed that an automatic synchronization of electromagnetic oscillations induced inside the individual cores of the multi-core magnetron will occur, which may or, most probably, may not take place. Thus, there is a need for additional measures leading to a forced synchronization of electromagnetic oscillations induced inside the individual cores of a multi-core magnetron.

SUMMARY

The present disclosure is directed toward a structure and technique to achieve phase synchronization of electromagnetic oscillations induced inside individual cores (i.e., anode portions) of a multi-core (cascaded) magnetron. In accordance with one aspect of the concepts, structures and techniques described herein, axial straps are used to couple vanes of adjacent cores of a multi-core (cascaded) magnetron. With this particular arrangement, structure and technique which forces phase synchronization of electromagnetic oscillations induced inside individual cores of a multi-core (cascaded) magnetron are provided. The axial straps provide a direct electrical connection between one or more vanes of the adjacent cores.

In an embodiment, the axial straps are provided having a predetermined length selected to make an electrical length between centers of adjacent cores of a multi-core (cascaded) magnetron equal or proportional to one half of a wavelength of electromagnetic oscillations induced inside the cores. This structure results in phase synchronization of electromagnetic oscillations induced inside the adjacent cores of a multi-core (cascaded) magnetron.

According to one aspect of the present disclosure, a multi-core (cascaded) magnetron is provided having a cathode and a plurality of cores arranged in an axial direction along a length of the cathode. Each of the cores may have a plurality of vanes arranged periodically in an azimuthal direction along a circumference of the cathode and forming by such a way a plurality of resonant cavities. The multi-core (cascaded) magnetron further includes groups of axial straps coupling each pair of the adjacent cores together in the axial direction along the length of the cathode. In one illustrative embodiment, a first group of axial straps couple a plurality of vanes of a first core to a plurality of vanes of a second core, a second group of axial straps couple a plurality of vanes of a second core to a plurality of vanes of a third core, etc. In an embodiment, the groups of axial straps are configured to provide phase synchronization of electromagnetic oscillations induced inside each of the plurality of cores of a multi-core (cascaded) magnetron.

An axial strap may have a predetermined length, whereby the predetermined length provides a predetermined phase difference between electromagnetic oscillations induced inside the adjacent cores having the axial strap coupled in-between them. In some embodiments, the cores formed by a plurality of its respective resonant cavities and vanes are spaced the predetermined length from each other. The predetermined length may provide an electrical length between centers of adjacent cores of the multi-core (cascaded) magnetron such that the electrical length is equal or proportional to one half of wavelength of electromagnetic oscillations induced inside each of the cores. In an embodiment, the predetermined length is a length of the axial strap.

The groups of axial straps provide phase synchronization of electromagnetic oscillations induced inside each of the cores. The cores may be positioned face to face in a linear cascade arrangement along the length of the cathode and each of the axial straps is positioned parallel with respect to a central longitudinal axis of the cathode. In some embodiments, the axial straps may be metal rods or wires. The groups of axial straps electrically couple one or more vanes of each of the core to one or more vanes of an adjacent core.

In an embodiment, each of the plurality of cores may have a plurality of vanes and a hollow center portion. In other words, each of the plurality of cores includes of a plurality of resonant cavities arranged around the hollow center portion and the cathode may extend through the hollow center portion of each of the plurality of cores.

According to another aspect of the present disclosure, a multi-core (cascaded) magnetron is provided that includes a cathode and a plurality of cores arranged in an axial direction along a length of the cathode. Each of the cores may have a plurality of vanes arranged periodically in an azimuthal direction along a circumference of the cathode and forming a plurality of resonant cavities. The multi-core (cascaded) magnetron further includes groups of axial straps coupling each pair of the adjacent cores together in the axial direction along the length of the cathode. Each axial strap may have a predetermined length to provide phase synchronization of electromagnetic oscillations induced inside the multi-core (cascaded) magnetron formed by at least two cores coupled by at least one axial strap.

BRIEF DESCRIPTION OF THE DRAWINGS

The foregoing features may be more fully understood from the following description of the drawings. The drawings aid in explaining and understanding the disclosed technology. Since it is often impractical or impossible to illustrate and describe every possible embodiment, the provided figures depict one or more exemplary embodiments. Accordingly, the figures are not intended to limit the scope of the invention. Like numbers in the figures denote like elements.

FIG. 2 is an isometric view of a double-core magnetron with one group of axial straps having two axial straps, FIG. 2C is an isometric view of a double-core magnetron with one group of axial straps having three axial straps;

DETAILED DESCRIPTION

The present disclosure is directed toward a multi-core magnetron having a plurality of cores electrically coupled together by axial straps. The axial straps couple vanes of adjacent cores of the multi-core magnetron to synchronize electromagnetic oscillations induced inside the cores and provide, in this way, the phase synchronization of electromagnetic oscillations induced inside the cores. For example, the axial straps synchronize electromagnetic oscillations inside a first core with ones inside a second core.

Figure 1:
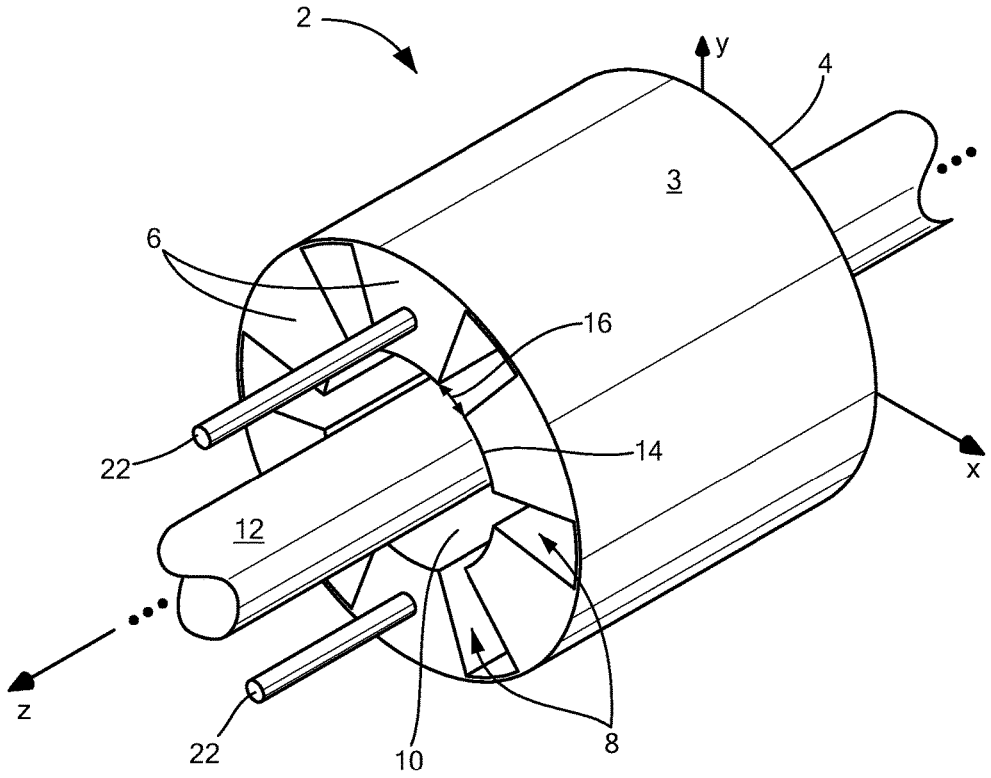
FIG. 1 is an isometric view of a right-most core of a multi-core magnetron with two axial straps.

Now referring to FIG. 1, a right-most core of a multi-core magnetron 2 includes an anode (core) 4 having a housing 3, plurality of vanes 6 (here, six vanes) and a hollow center portion 10. Housing 3 and vanes 6 define a plurality of resonant cavities 8 (here, six resonant cavities) formed between each pair of adjacent vanes of the plurality of vanes 6. A cathode 12 is disposed through the hollow center portion 10. In an embodiment, the plurality of vanes 6 are arranged in an azimuthal direction around a circumference of hollow center portion 10 and cathode 12. Two axial straps 22 extend from left faces of two vanes 6 of magnetron 2, as will be discussed in further detail below.

An interaction space is provided between cathode 12 and an inner edge 14 of each of the plurality of vanes 6. Each of the resonant cavities 8 formed between vanes 6 has a slot 16 (e.g., opening) that opens into and connects resonant cavity 8 with the interaction space. In an embodiment, the interaction space is provided to allow electrons produced by the cathode to interact with one of space harmonics of electromagnetic oscillations induced within the interaction space of the magnetron 2. Thus, magnetron 2 may be referred to as a multi-resonant-cavity or multi-vane device, whereby the interaction of electrons produced by cathode 12, positioned adjacent to inner edge 14 of each of the plurality of vanes 6, with one of space harmonics of electromagnetic oscillations induced within the interaction space of the magnetron 2 produces output electromagnetic radiation.

As illustrated in FIG. 1, core 4 may be formed or otherwise provided having a cylindrical shape. However, it should be appreciated that core 4 may be other shapes depending on particular application and/or desired configuration of magnetron 2. Further, the particular dimensions and size of core 4 may be selected based on a particular application and/or desired configuration forming by such a way, for example, a rectangular magnetron.

Each of the plurality of vanes 6 may be formed from an electrically conductive material, such as a metal block. The plurality of vanes 6 may have a resonant frequency based upon characteristics (e.g., shape, size and dimensions) of the respective resonant cavities 8. In an embodiment, each of the vanes 6 and resonant cavities 8 have the same shape, size and dimensions. Alternatively, one or more vanes 6 may have a different shape, size and/or dimensions from another vane 6 and one or more resonant cavities 8 may have a different shape, size and/or dimensions from another resonant cavity 8 forming by such a way, for example, a rising-sun magnetron.

The shape, dimensions and properties of vanes 6 and resonant cavities 8 may be designed based upon a particular application and desired frequency of magnetron operation. For example, FIG. 1 illustrates each of the vanes 6 as having a truncated triangular shape with spherically curved inner edges 14. Likewise, resonant cavities 8 are formed as having a truncated triangular shape with spherically curved slots 16. However, vanes 6 and resonant cavities 8 may be provided having a variety of shapes (e.g., spherical, circular, rectangular, etc.) and dimensions based upon the needs of a particular application.

In an embodiment, core 4 is an anode element surrounding cathode 12. Cathode 12 may be an electrically conductive rod disposed through hollow center portion 10. Many different configurations and geometries of cathode 12 may be used included, but not limited by, shaped, transparent, and multi-rod cathodes. Cathode 12 may be configured to produce electrons. For example, cathode 12 may be heated or otherwise excited in order to produce electrons that are emitted (i.e., streamed out) into the interaction space between cathode 12 and inner edges 14 of the plurality of vanes 6. An external magnetic field (not shown) may be applied in a direction parallel to cathode 12. Thus, electrons produced by cathode 12 interact with the magnetic field and the electric field stretching between the vanes 6 and cathode 12, causing the electrons to move in a sweeping direction around the circumference of cathode 12.

In some embodiments, electromagnetic oscillations are induced within the interaction space of the magnetron. If two or more cores are combined to form a multi-core magnetron, each core should be electromagnetically coupled with adjacent cores, which means that electromagnetic oscillations induced in all cores of the multi-core magnetron should be phase synchronized with each other to avoid loss of induced electromagnetic energy and allow the multi-core magnetron to operate efficiently.

Figure 2:
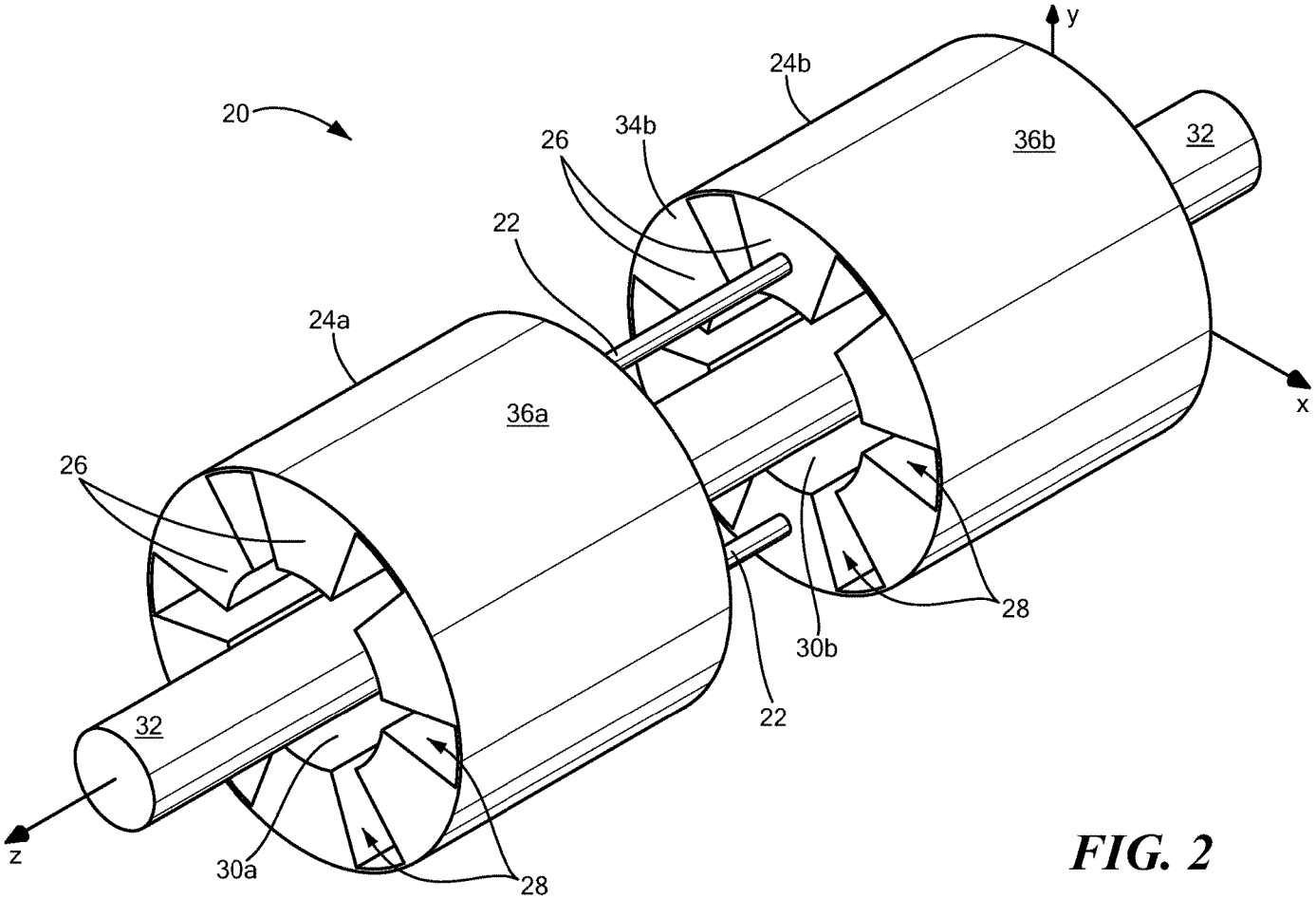
FIGS. 2-2C are isometric views of double-core magnetrons with axial straps, where

Now referring to FIG. 2, a double-core magnetron 20 includes a pair of cores 24*a*, 24*b* disposed about a cathode 32 and coupled together by a pair of axial straps 22. Both cores 24*a*, 24*b* may be substantially similar to core 4 discussed above with respect to FIG. 1. For example, first and second cores 24*a*, 24*b* each include a plurality of vanes 26 and a hollow center portion 30. Resonant cavities 28 are formed between each pair of adjacent vanes of the plurality of vanes 26. Cathode 32 may be disposed such that it extends through hollow center portion 30*a*, 30*b* of both cores 24*a*, 24*b*.

Cores 24*a*, 24*b*, may be positioned face to face (or end to end) in a linear cascade arrangement along the length of cathode 32. Each of the cores 24*a*, 24*b* in the double-core magnetron 20 may have the same shape, size and dimensions, thus having similar electromagnetic characteristics. Cores 24*a*, 24*b* are spaced a predetermined length (i.e., distance) from each other with the spacing of cores 24*a*, 24*b* determined by a length of axial straps 22.

Axial straps 22 couple adjacent cores 24*a*, 24*b* together in a direction along the length (i.e., a central longitudinal axis, here shown as a Z-axis) of cathode 32. For example, axial straps 22 may lie in a plane parallel to cathode 32. In some embodiments, axial straps 22 are symmetrically coupled to adjacent cores 24*a*, 24*b*.

Axial straps 22 may be provided as electrically conductive rods or wires having any type of cross-sectional shape (e.g., circular cross-section, rectangular cross-section, etc.) As illustrated in FIG. 2, axial straps 22 may have a circular cross-sectional shape. However, it should be noted that other shapes and designs of axial straps 22 may be used to couple adjacent cores 24*a*, 24*b* together.

In an embodiment, axial straps 22 couple facing to each other vanes 26 of adjacent cores 24*a*, 24*b*. For example, an axial strap 22 may couple a face portion 34*a* (not shown) of a vane 26*a* of first core 24*a* to a face portion 34*b* of a vane 26*b* of second core 24*b*. Axial straps 22 may be coupled directly onto a surface of the face portion 34 of vane 26. In one embodiment, axial straps 22 are soldered or welded to the face of the vanes 26. In an embodiment, axial straps 22 may be coupled to the surface of the face portion 34 of vane 26 by any known method of forming an electrical connection. In some embodiments, adjacent cores 24*a*, 24*b* with axial straps 22 are manufactured as one single piece of metal using an additive manufacturing process, such as 3D printing.

In some embodiments, axial straps 22 are coupled to a central region of the face portions 34 of each of the vanes 26. In other embodiments, axial straps 22 may be coupled to an edge or border region of the face portions 34 of vanes 26. When a group of (i.e., two or more) axial straps 22 couple adjacent cores 24*a*, 24*b*, each of the axial straps 22 may be connected to the same or substantially similar area of each of the vanes 26. In other embodiments, each of the axial straps 22 may be connected to the different areas of each of the vanes 26. For example, a first axial strap 22 may be connected to a central region and a second axial strap 22 may be connected to a border region of the face portion of a vane 26. The exact region of the vanes 26 where the axial straps are connected to the vanes 26 may be determined by obtaining the most effective operation of the multi-core magnetron using empirical techniques, analytical techniques, or by using numerical simulations of the multi-core magnetron.

Any number or groups of axial straps 22 may be used to couple adjacent cores 24*a*, 24*b* together. A group of axial straps 22 refers to two or more axial straps coupling vanes 26 of adjacent cores 24*a*, 24*b*. For example, and as illustrated in FIG. 2, the group of axial straps 22 (here shown as two axial straps) couples vanes 26 of first core 24*a* to vanes 26 of second core 24*b*. The number of axial straps 22 in a single group of axial straps may depend on a particular application and/or desired configuration of the multi-core (cascaded) magnetron 20.

Figure 2A:
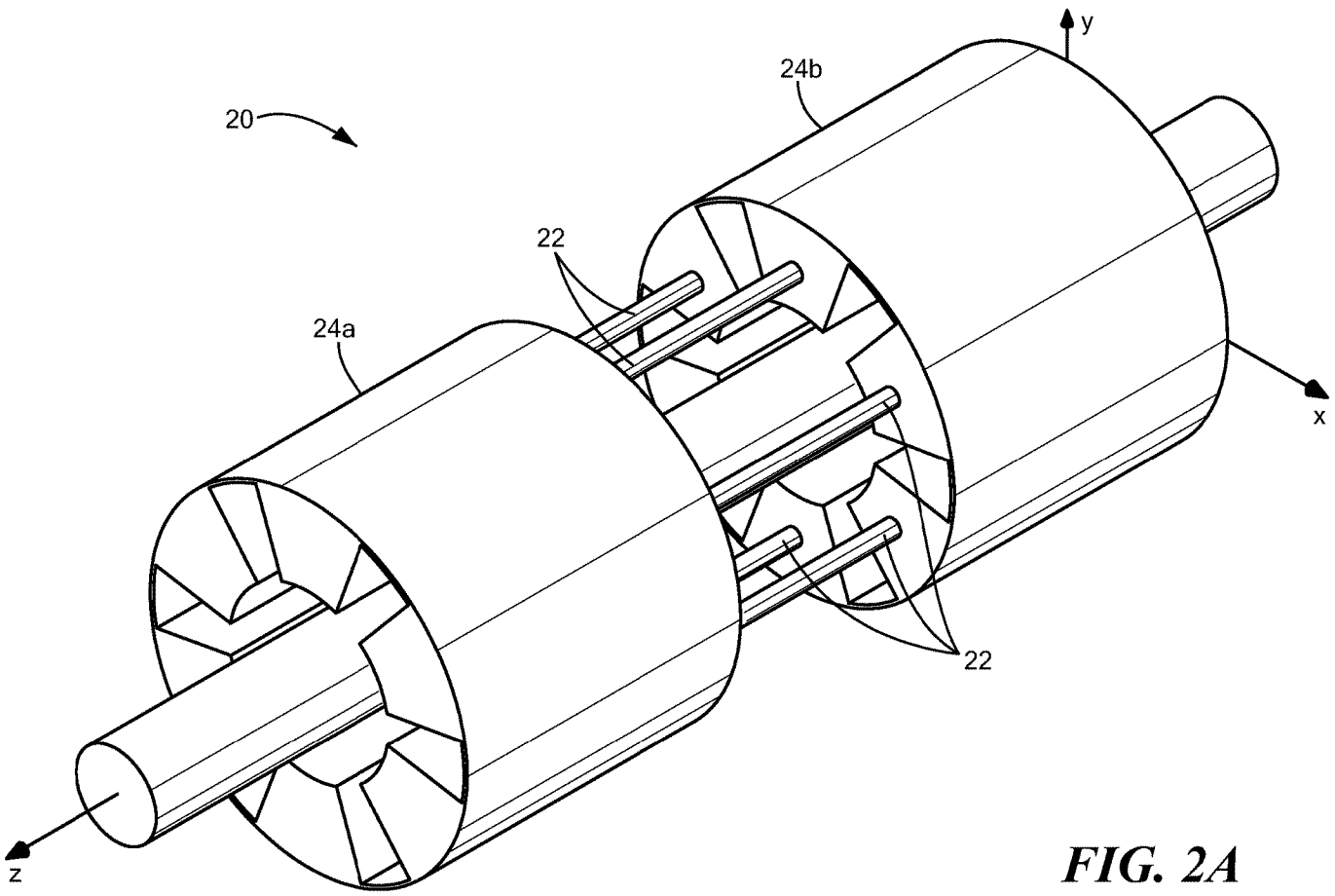
FIG. 2A is an isometric view of a double-core magnetron with one group of axial straps having six axial straps.

For example, and as illustrated in FIG. 2A, the number of axial straps 22 may correspond to the number of vanes 26 of a core 24.

Figure 2B:
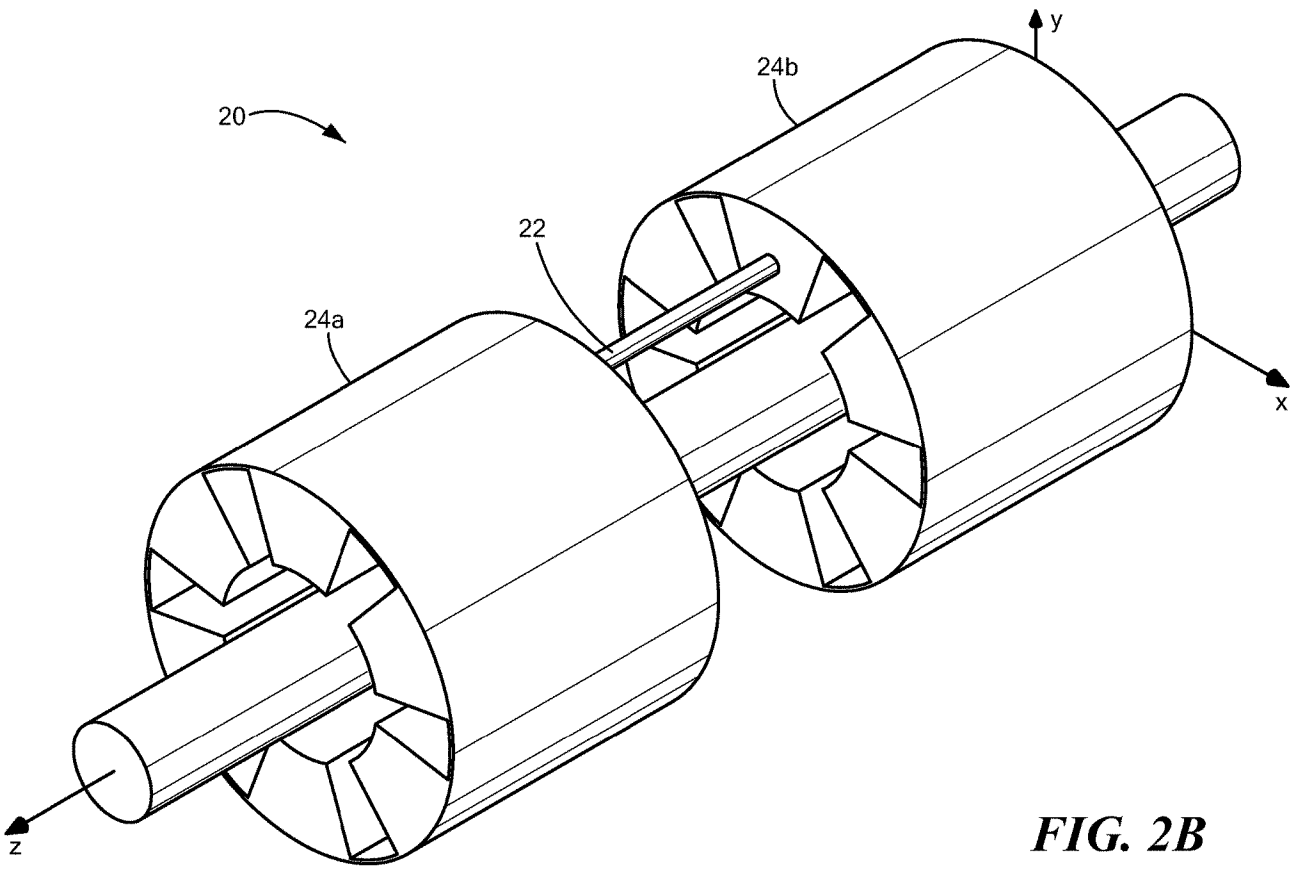
FIG. 2B is an isometric view of a double-core magnetron with one axial strap between the cores.

In other embodiments, a single axial strap 22 may be used to couple adjacent cores 24*a*, 24*b* together, as illustrated in FIG. 2B.

Figure 2C:
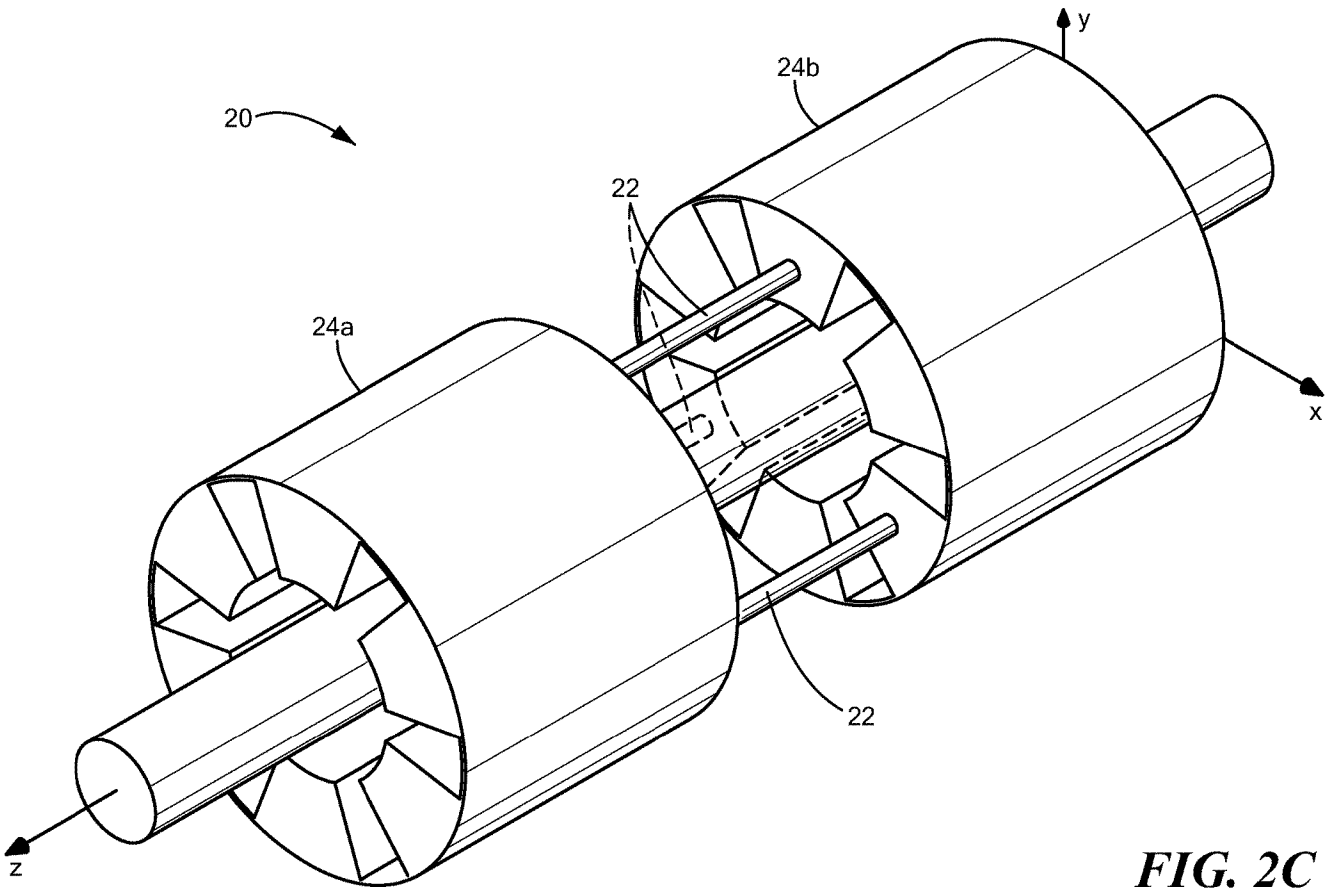

In still other embodiments, two or more axial straps 22 may be used to couple adjacent cores 24*a*, 24*b* together as illustrated in FIG. 2C.

The number of axial straps 22 used in a multi-core magnetron 20 may depend upon a variety of factors including, but not limited to determining the most effective operation of the multi-core magnetron. The exact number of axial straps to use in any of the above embodiments may be determined by either empirical, or analytical, or numerical techniques.

In an embodiment, axial straps 22 provide phase synchronization of electromagnetic oscillations induced inside individual cores 24*a*, 24*b* (i.e., anode elements) of the multi-core magnetron 20. Each core 24 is an individual oscillator in the multi-core magnetron 20. Thus, as each core 24*a*, 24*b* is arranged in juxtaposition to cathode 32 and to each other, axial straps 22 provide a direct electrical connection between adjacent cores 24*a*, 24*b*.

In other words, axial straps 22 electrically couple vanes 26 of adjacent cores 24*a*, 24*b* together. In some embodiments, axial straps 22 transfer electromagnetic energy from a first core 24*a* to a second core 24*b* and back from a second core 24*b* to a first core 24*a* in the oscillation mode.

Axial straps 22 are configured to provide phase synchronization of electromagnetic oscillations induced inside each core 24 of the multi-core magnetron 20. The phase coupling (i.e., phase locking) of separate cores (anode elements) 24*a*, 24*b* may be achieved by selecting such a length of each axial strap 22 that makes an electrical length between centers 36*a*, 36*b* (FIG. 2) of adjacent cores 24*a*, 24*b* of a multi-core magnetron 20 equal or proportional to one half of a wavelength ($\lambda/2$) of electromagnetic oscillations induced inside the cores 24*a*, 24*b*.

Figure 3:
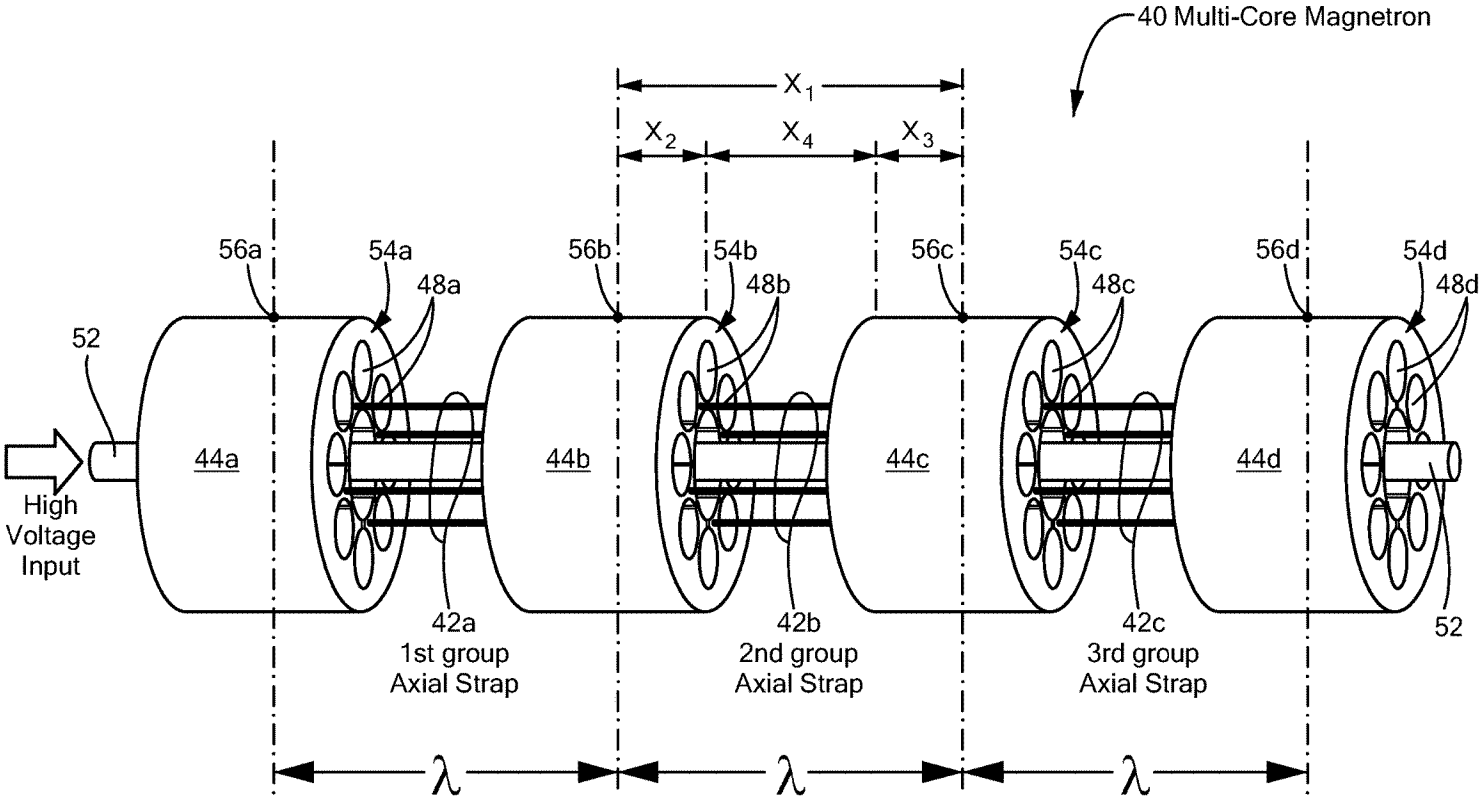
FIG. 3 is an isometric view of a four-core magnetron with three groups of axial straps each having four axial straps.

Now referring to FIG. 3, a multi-core magnetron 40 includes a plurality of cores 44, here four cores 44*a*, 44*b*, 44*c*, 44*d*, positioned end to end in a linear cascade arrangement along a length of cathode 52. Each pair of adjacent cores (e.g., 44*a*-44*b*, 44*b*-44*c*, 44*c*-44*d*) are coupled together by a group of axial straps 42*a*, 42*b*, 42*c*. For example, a first group of axial straps 42*a* couples together vanes of first core 44*a* to vanes of second core 44*b*. A second group of axial straps 42*b* couples together vanes of second core 44*b* to vanes of third core 44*c*. A third group of axial straps 42*c* couples together vanes of third core 44*c* to vanes of fourth core 44*d*.

Each of the cores 44*a*, 44*b*, 44*c*, 44*d* are spaced a predetermined length from each other. In an embodiment, each pair of adjacent cores (e.g., 44*a*-44*b*, 44*b*-44*c*, 44*c*-44*d*) are spaced the same length as another pair of adjacent cores. The predetermined length may be a length of the respective groups of axial straps 42*a*, 42*b*, 42*c* coupling the adjacent cores 24 together. In some embodiments, the predetermined length provides an electrical length between centers 56*a*, 56*b*, 56*c*, 56*d* of adjacent cores 44 of the multi-core magnetron 22 such that the electrical length is equal or proportional to one half of wavelength ($\lambda/2$) of electromagnetic oscillations induced inside each of the cores 44.

The electrical length, $X_1$, between each pair of adjacent cores (e.g., 44*a*-44*b*, 44*b*-44*c*, 44*c*-44*d*) may be measured from each of their respective center points 56*a*, 56*b*, 56*c*, 56*d*. Thus, the length of each axial strap 42 (also the length of each group of axial straps), $X_4$, may be defined as the distance between each face portions 54 of adjacent cores 44.

In some embodiments, the length of each axial strap 42, $X_4$, may be defined as the electrical length, $X_1$, recalculated to a distance between centers 56*b*, 56*c* of adjacent cores 44*b*, 24*c* of a multi-core magnetron minus the sum of the distances from second center portion 56*b* to face portion 54*b* (i.e., edge of core 44*b*), $X_2$, and from third center point 36*c* to face portion 54*c* (i.e., edge of core 44*c*), $X_3$. It should be appreciated that the length of axial straps 42 may vary based on properties, dimensions, and characteristics of different portions (e.g., cathode, anode) of a particular multi-core magnetron being used and desired operational characteristics of the multi-core magnetron.

In some embodiments, axial straps 42 have a predetermined length. The predetermined length may provide a phase difference between electromagnetic oscillations induced inside the adjacent cores 44 (e.g., 44*a*-44*b*, 44*b*-44*c*, 44*c*-44*d*) coupled together by the axial straps 42. For example, first core 44*a* may operate with a fixed phase difference from second core 44*b* that it is coupled to first core 44*a* by first grouping of axial straps 42*a*. In some embodiments, axial straps 42 may be used to control the phase difference between pairs of adjacent cores 44 (e.g., 44*a*-44*b*, 44*b*-44*c*, 44*c*-44*d*).

The length of each axial strap 42 may be selected based upon empirical techniques, analytical techniques, or upon numerical simulations of the multi-core magnetron determining the most effective operation of the multi-core magnetron.

It should of course be understood that while the present technology has been described with respect to disclosed embodiments, numerous variations, alternate embodiments, equivalents, etc. are possible without departing from the spirit and scope of the claims.

In addition, it is intended that the scope of the present claims include all other foreseeable equivalents to the elements and structures as described herein and with reference to the drawing figures. Accordingly, the subject matter sought to be protected herein is to be limited only by the scope of the claims and their equivalents.

Having described preferred embodiments which serve to illustrate various concepts, structures and techniques, which are the subject of this patent, it will now become apparent to those of ordinary skill in the art that other embodiments incorporating these concepts, structures and techniques may be used. For example, it should be noted that individual concepts, features (or elements) and techniques of different embodiments described herein may be combined to form other embodiments not specifically set forth above. Furthermore, various concepts, features (or elements) and techniques, which are described in the context of a single embodiment, may also be provided separately or in any suitable sub-combination. It is thus expected that other embodiments not specifically described herein are also within the scope of the following claims.

Accordingly, it is submitted that that scope of the patent should not be limited to the described embodiments, but rather should be limited only by the spirit and scope of the following claims.

All publications and references cited herein are expressly incorporated herein by reference in their entirety.

What is claimed:

1. A multi-core magnetron comprising:

a cathode;

a plurality of cores arranged in an axial direction along a length of the cathode, wherein each of the cores has a plurality of vanes arranged periodically in an azimuthal direction along a circumference of the cathode and forming by such a way a plurality of resonant cavities; and at least one axial strap coupling adjacent cores together in the axial direction along the length of the cathode, wherein a first axial strap couples a first vane of a first core to a first vane of a second core.

2. The multi-core magnetron of claim 1, wherein the at least one axial strap is configured to provide phase synchronization of electromagnetic oscillations induced inside each of the plurality of cores.

3. The multi-core magnetron of claim 1, wherein the at least one axial strap has a predetermined length, and wherein the predetermined length provides a predetermined phase difference between electromagnetic oscillations induced inside a pair of the adjacent cores coupled by the at least one axial strap.

4. The multi-core magnetron of claim 3, wherein each of the cores formed by a plurality of its respective vanes are spaced the predetermined length from each other, wherein the predetermined length is a length of the at least one axial strap.

5. The multi-core magnetron of claim 3, wherein the predetermined length provides an electrical length between centers of adjacent cores of the multi-core magnetron such that the electrical length is equal or proportional to one half of a wavelength of electromagnetic oscillations induced inside each of the cores.

6. The multi-core magnetron of claim 1, wherein the at least one axial strap provides phase synchronization of electromagnetic oscillations induced inside each of the cores.

7. The multi-core magnetron of claim 1, wherein the individual cores are positioned face to face in a linear cascade arrangement along the length of the cathode.

8. The multi-core magnetron of claim 1, further comprising a plurality of axial straps coupling adjacent cores together in the axial direction along the length of the cathode, wherein each of the plurality of axial straps are positioned parallel with respect to the cathode.

9. The multi-core magnetron of claim 1, further comprising a plurality of axial straps coupling adjacent cores together in the axial direction along the length of the cathode, wherein each of the plurality of axial straps are positioned along a spiral path with respect to the cathode or at a predetermined angle with respect to the cathode.

10. The multi-core magnetron of claim 8, wherein the plurality of axial straps electrically couple vanes of each of the cores to vanes of an adjacent core.

11. The multi-core magnetron of claim 1, wherein the at least one axial strap comprises metal rods or wires.

12. The multi-core magnetron of claim 1, wherein each of the plurality of cores have a plurality of vanes and a hollow center portion, and wherein each of the plurality of cores have a plurality of resonant cavities arranged around the hollow center portion, and wherein the cathode extends through the hollow center portion of each of the plurality of cores.

13. A multi-core magnetron comprising:

a cathode;

a plurality of cores arranged in an axial direction along a length of the cathode, wherein each of the cores have a plurality of vanes arranged periodically in an azimuthal direction along a circumference of the cathode and forming a plurality of resonant cavities; and a group of axial straps coupling each of the adjacent cores together in the axial direction along the length of the cathode, wherein each axial strap has a predetermined length to provide phase synchronization of electromagnetic oscillations induced inside the plurality of cores coupled by at least one axial strap.

14. The multi-core magnetron of claim 13, wherein the group of axial straps is configured to provide phase synchronization of electromagnetic oscillations induced inside each of the plurality of cores.

15. The multi-core magnetron of claim 13, wherein a first group of axial straps couple a first plurality of vanes of a first core to a second plurality of vanes of a second core, and a second group of axial straps couple a third plurality of vanes of the second core to a fourth plurality of vanes of a third core.

16. The multi-core magnetron of claim 13, wherein each of the cores formed by a plurality of its respective vanes are spaced the predetermined length from each other, wherein the predetermined length is a length of the axial strap.

17. The multi-core magnetron of claim 13, wherein the predetermined length provides an electrical length between centers of adjacent cores of the multi-core magnetron such that the electrical length is equal or proportional to one half of wavelength of electromagnetic oscillations induced inside each of the cores.

18. The multi-core magnetron of claim 13, wherein the group of axial straps provides phase synchronization of electromagnetic oscillations induced inside each of the cores.

19. The multi-core magnetron of claim 13, wherein the cores are positioned face to face in a linear cascade arrangement along the cathode.

20. The multi-core magnetron of claim 13, wherein each of the axial straps are positioned parallel with the cathode.

21. The multi-core magnetron of claim 13, wherein each of the axial straps are positioned along either a spiral path with respect to the cathode or at a predetermined angle with respect to the cathode.

22. The multi-core magnetron of claim 13, wherein the axial straps comprise metal rods or wires.

23. The multi-core magnetron of claim 13, wherein the group of axial straps electrically couple vanes of each of the cores to vanes of an adjacent core.

24. The multi-core magnetron of claim 13, wherein each of the plurality of cores have a plurality of vanes and a hollow center portion, and wherein each of the plurality of cores have a plurality of resonant cavities arranged around the hollow center portion, and wherein the cathode extends through the hollow center portion of each of the plurality of cores.

* * * * *